US005541616A

United States Patent [19]

Kawahata et al.

[11] Patent Number: 5,541,616

[45] Date of Patent: Jul. 30, 1996

[54] SURFACE-MOUNTABLE ANTENNA

[75] Inventors: Kazunari Kawahata; Yuichi Kushihi, both of Kyoto, Japan

[73] Assignee: Murata Manufacturing Co., Ltd., Japan

[21] Appl. No.: 399,240

[22] Filed: Mar. 6, 1995

[30] Foreign Application Priority Data

Mar. 9, 1994 [JP] Japan ..... 6-038679

[51] Int. Cl.[6] ..... H01Q 1/40

[52] U.S. Cl. ..... 343/873; 343/702; 343/815

[58] Field of Search ..... 343/702, 700 MS, 343/815, 817, 818, 872, 873; H01Q 1/40

[56] References Cited

U.S. PATENT DOCUMENTS 3,155,975 11/1964 Chatelain ..... 343/873

4,218,682 8/1980 Yu ..... 343/700 MS 5,463,404 10/1995 Wall ..... 343/873

*Primary Examiner*—Donald T. Hajec

*Assistant Examiner*—Tan Ho

*Attorney, Agent, or Firm*—Ostrolenk, Faber, Gerb & Soffen, LLP

[57] ABSTRACT

A surface-mountable antenna is mounted on a substrate at one surface of its dielectric substrate, and is supplied with an RF signal by a feeding part which is provided on the substrate. The dielectric substrate is provided with one feeding through hole and at least one auxiliary through hole in parallel with each other, while a radiating electrode is formed on the inner peripheral surface of the feeding through hole. Further, end electrodes are formed on a surface of the dielectric substrate around the feeding and auxiliary through holes respectively, while an auxiliary electrode is formed on the inner peripheral surface of the auxiliary through hole. Due to this structure, it is possible to provide an antenna which is surface-mountable, has a high gain and controllable directivity.

18 Claims, 5 Drawing Sheets

SURFACE-MOUNTABLE ANTENNA

BACKGROUND OF THE INVENTION

1. Field of the Invention

The present invention relates to a surface-mountable antenna which is mounted on a substrate at a surface of its dielectric substrate, to be supplied with electricity from a feeding part provided on the substrate, and more particularly, it relates to an improved surface-mountable antenna with controllable directivity.

2. Description of the Background Art

With the recent prevalence of car telephones and portable telephones, there is a great need for miniaturization of antennas for transmitting/receiving high-frequency signals for such telephones.

FIGS. 5A and 5B are perspective views showing an antenna 10 for a communication device such as a portable telephone and the body 80 of the communication device respectively. The antenna 10 is a dielectric-loaded monopole antenna. In this antenna 10, a through hole 30 is formed in a cylindrical dielectric body 20, and a radiating electrode 40 which is made of Cu, for example, is formed on the inner periphery of the through hole 30. Further, a male connector 60 is mounted on one end surface of the dielectric body 20. This male connector 60 is connected with a female connector 70 which is provided on a body 80 of the communication device, thereby enabling the supply of electricity to the radiating electrode 40 and transmitting/receiving of high-frequency signals.

In such a communication device, however, the antenna 10 is provided outside the body 80 of the communication device, which hinders the miniaturization of the communication device, and further, an external force can act directly on the antenna 10. Thus, there is a probability of causing problems such as a reduction in mechanical strength and durability, and changes of its electrical characteristics.

In such a communication device, further, the high-frequency signals are transmitted/received through the connectors 60 and 70, leading to problems such as an increase in insertion loss and a change of the resonance frequency.

In addition, the number in components of such a communication device is increased due to employment of the connectors 60 and 70, to disadvantageously reduce its workability and increase its cost.

To this end, there has been developed a surface-mountable antenna 11 which is directly mounted on a substrate with no employment of connectors, as shown in FIG. 6.

In this surface-mountable antenna 11, a through hole 33 is formed in a prismatic dielectric substrate 22 between first and second end surfaces thereof, and a radiating electrode 44 is formed on the inner peripheral surface of this through hole 33. Further, an end electrode 99 is formed on the first end surface of the dielectric substrate 22. This end electrode 99 is connected with the radiating electrode 44.

A substrate 100 is enclosed in a case for the body of a communication device or the like, thereby mounting the surface-mountable antenna 11 in the case. This substrate 100 is provided on its mounting main surface with a feeder line 140 serving as a feeding part for the surface-mountable antenna 11, and signal processing circuits (not shown) such as a transmission circuit and a receiving circuit.

The surface-mountable antenna 11 is placed on the substrate 100 on its mounting side surface, to be connected and fixed to the substrate 100 by solder and an adhesive (not shown), for example, so that the end electrode 99 faces the feeder line 140.

Further, fixing electrodes 88 are formed along side and bottom surfaces of the dielectric substrate 22. The surface-mountable antenna 11 is connected and fixed to the substrate 100 by solder and an adhesive (not shown) similarly to the above, so that the fixing electrodes 88 face fixing conductors 180 which are formed on the mounting main surface of the substrate 100.

As compared with the conventional dielectric-loaded antenna, this surface-mountable antenna 11 is advantageous in that the same can be directly surface-mounted on the substrate 100 with no requirement for connectors.

However, the conventional monopole type surface-mountable antenna has the following problem, since its directivity cannot be controlled: When the antenna is applied to a portable telephone, for example, this antenna is integrated into the device as a matter of course. In the conventional antenna, therefore, it is impossible to avoid problems such as mutual interference between systems being used and generation of radio waves toward another device or the human body.

In the conventional monopole type surface-mountable antenna, further, it is difficult to attain a high gain due to dispersion of the directivity.

SUMMARY OF THE INVENTION

An object of the present invention is to provide a surface-mountable antenna which is surface-mountable and has controllable directivity.

Another object of the present invention is to improve the gain of such an antenna.

A surface-mountable antenna according to the present invention is provided with a dielectric substrate which is mounted on a substrate having a feeding part. It is mounted at its mounting surface and is supplied with electricity from the feeding part. It comprises a feeding through hole which is formed to pass through the dielectric substrate along the mounting surface and is supplied with electricity (a signal) from the feeding part, at least one auxiliary through hole which is formed to pass through the dielectric substrate in parallel with the feeding through hole and is not supplied with electricity from the feeding part, and a radiating electrode which is formed on the inner peripheral surface of the feeding through hole and is supplied with electricity from the feeding part.

The surface-mountable antenna may further comprise an auxiliary electrode which is formed on the inner peripheral surface of the auxiliary through hole and supplied with electricity from the feeding part.

The surface-mountable antenna may further comprise a first end electrode which is formed on a first end surface of the dielectric substrate provided with respective first opening portions of the feeding and auxiliary through holes around the opening portion of the feeding through hole to be interposed between the feeding part and the radiating electrode, and a second end electrode which is formed on the first end surface of the dielectric substrate around the auxiliary through hole to be connected to the auxiliary electrode.

The surface-mountable antenna may further comprise a capacitor for electrically connecting the feeding and auxiliary through holes with each other.

The surface-mountable antenna may further comprise a reflecting electrode which is formed on the inner peripheral surface of the auxiliary through hole.

Due to the feeding through hole having a radiating electrode and the auxiliary through hole which are formed in the dielectric substrate in parallel with each other, the directivity is intensified on the side of the auxiliary electrode having a low dielectric constant. Thus, it is possible to control the directivity. Due to the first and second end electrodes which are provided on the sides of the feeding and auxiliary through holes respectively, further, the antenna operates as a phased-array antenna, and its directivity can be controlled. Further, it is possible to control the directivity on the basis of the principle of the phased-array antenna by electrically connecting the feeding through hole with the auxiliary through hole by a capacitor or the like.

According to the present invention, therefore, it is possible to implement a surface-mountable antenna whose dielectric substrate can be directly mounted on a mounting substrate which is enclosed in a communication device such as a portable telephone without requiring any connectors etc., with readily controllable directivity. Consequently, it is possible to reduce mutual interference between different systems in use simultaneously and to reduce any effect of radio waves on the communication device and the human body.

According to the present invention, further, it is also possible to attain a high gain by controlling the directivity for intensifying the radiated signal on one side.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described in detail with reference to FIGS. 1A to 4.

Figure 1A:
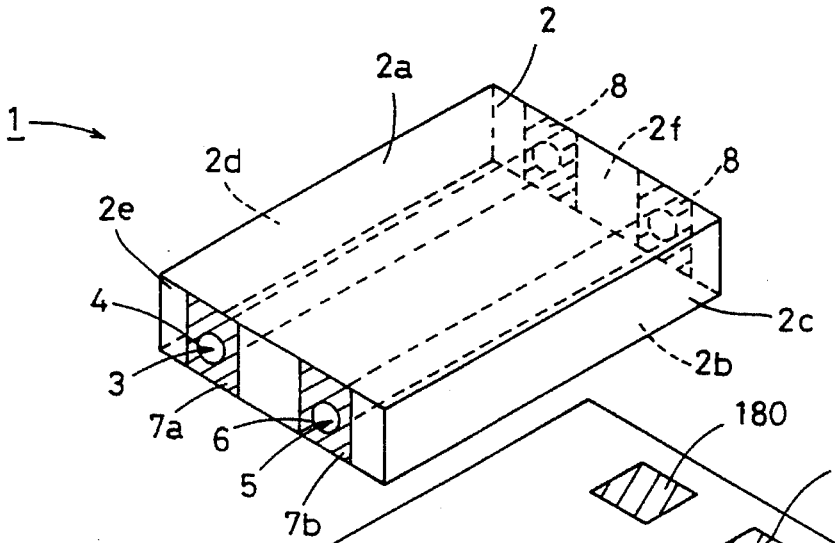
FIGS. 1A and 1B are perspective views showing a surface-mountable antenna according to a first embodiment of the present invention and a substrate for mounting the same respectively.

Referring to FIG. 1A, a surface-mountable antenna 1 comprises a dielectric substrate 2 which is made of ceramics, polypropylene resin, polybutylene terephthalate resin or polycarbonate resin, for example, and a feeding through hole 3 which is formed in this dielectric substrate 2 between first and second end surfaces 2*e* and 2*f* thereof. A radiating electrode 4 of Cu, Ag, Ag-Pd or Ag-Pt is formed on the inner peripheral surface of the feeding through hole 3, by plating or application of conductive paste, for example.

The surface-mountable antenna 1 having the aforementioned structure generates a high-frequency electromagnetic field upon supply of high-frequency power to the radiating electrode 4, to transmit a radio wave from the radiating electrode 4. A high-frequency current is induce in the radiating electrode 4 when the same receives a radio wave, which then can be transmitted to a transmission line.

First Embodiment

Figure 1B:
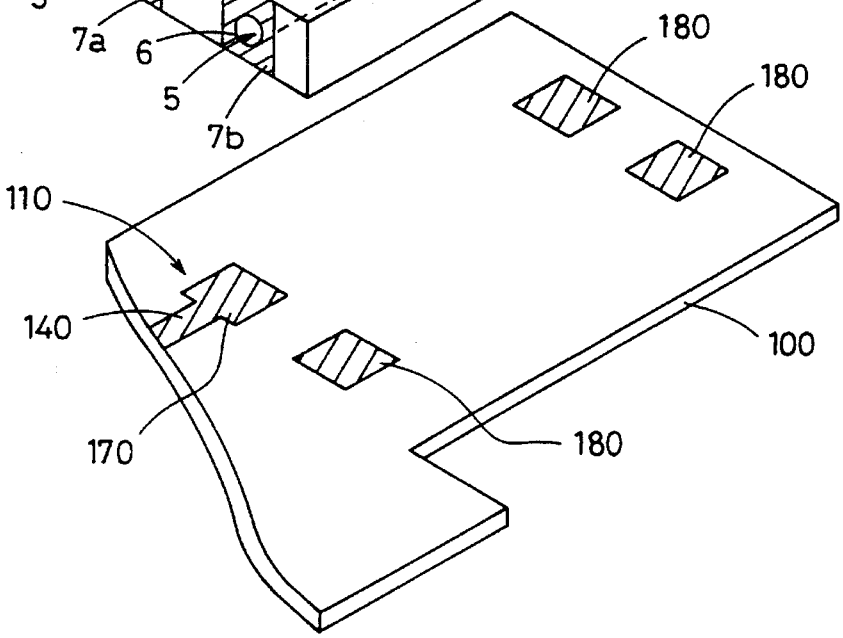

FIGS. 1A and 1B are perspective views showing the surface-mountable antenna 1 according to a first embodiment of the present invention.

In addition to the aforementioned structure, the surface-mountable antenna 1 is further provided with an auxiliary through hole 5 in parallel with the feeding through hole 3. An auxiliary electrode 6 of Cu, Ag, Ag-Pd or Ag-Pt is formed on the inner peripheral surface of the auxiliary through hole 5 by plating or application of conductive paste, for example.

On a first end surface 2*e* of the dielectric substrate 2, end electrodes 7*a* and 7*b* are formed around the feeding and unfeeding through holes 3 and 5 respectively. The end electrode 7*a* is connected with the radiating electrode 4 which is formed on the inner peripheral surface of the feeding through hole 3. On the other hand, the end electrode 7*b* is connected with the auxiliary electrode 6 which is formed on the inner peripheral surface of the auxiliary through hole 5. Alternatively, the end electrodes 7*a* and 7*b* may be formed along the first end surface 2*e* and a bottom surface 2*b* of the dielectric substrate 2, in order to improve fixation strength with respect to a substrate, as will be described later.

On a second end surface 2*f* of the dielectric substrate 2, further, fixing electrodes 8 are formed at positions symmetrical to those of the end electrodes 7*a* and 7*b* respectively. The positions, shapes and number of the fixing electrodes 8 are not particularly restricted but rather are appropriately selected in response to the fixation strength and manufacturing cost requirement. In other words, the dielectric substrate 2 may be provided with only a single fixing electrode 8 on the second end surface 2*f*, or the fixing electrodes 8 may be formed on side surfaces 2*c* and 2*d*, or along the second end surface 2*f*, the side surface 2*c* or 2*d* and the bottom surface 2*b*. In consideration of the need for fixation strength to resist an external impact, however, such electrodes provided on the outer surface(s) of the dielectric substrate 2 are preferably formed with symmetry as a whole.

A mounting state of the surface-mountable antenna 1 on a substrate 100 is now described.

The mounting substrate 100 is provided with a feeding part 110, fixing conductors 180 and a feeder line 140. The feeding part 110 consists of a feeding conductor 170, and is connected with the feeder line 140.

The surface-mountable antenna 1 is placed on the substrate 100 so that the end electrodes 7*a* and 7*b* and the fixing electrodes 8 which are formed on the first and second end surfaces 2*e* and 2*f* of the dielectric substrate 2 face the feeding conductor 170 and the fixing conductors 180 which are formed on the substrate 100 respectively, and connected and fixed to the substrate 100 by solder and an adhesive (not shown), for example.

In this surface-mountable antenna 1, the radiating electrode 4 is supplied with electricity from a feeding source (not shown) through the feeder line 140, the feeding conductor 170 and the end electrode 7*a*.

According to this embodiment, the surface-mountable antenna 1 generates a high-frequency electromagnetic field when the radiating electrode 4 which is formed on the inner peripheral surface of the feeding through hole 3 is supplied with electricity, so that a current flows between the first and second end surfaces 2*e* and 2*f* of the dielectric substrate 2.

On the other hand, the auxiliary electrode 6 which is formed on the inner peripheral surface of the auxiliary through hole 5 is also fed with a current, due to coupling between the end electrodes 7*a* and 7*b*. This current is different in distribution from that flowing toward the feeding through hole 3. Further, the direction of the current flowing toward the auxiliary through hole 5 is varied with the strength of the coupling between the end electrodes 7*a* and 7*b*, and the strength of the degree of coupling depending on the arrangement of the feeding and auxiliary through holes 3 and 5 in the dielectric substrate 2.

In other words, it is possible to control the directivity of the radio wave which is radiated from the radiating electrode 4 to appear more intensely on the side of either the feeding through hole 3 or the auxiliary through hole 5, by adjusting differences between the phases and the reactance components of the currents flowing through the feeding and auxiliary through holes 3 and 5. Namely, the surface-mountable antenna 1 operates as a phased-array antenna.

When the directivity is so controlled as to intensively appear on one side, further, it is possible to improve the gain of the antenna 1.

Second Embodiment

Figure 2A:
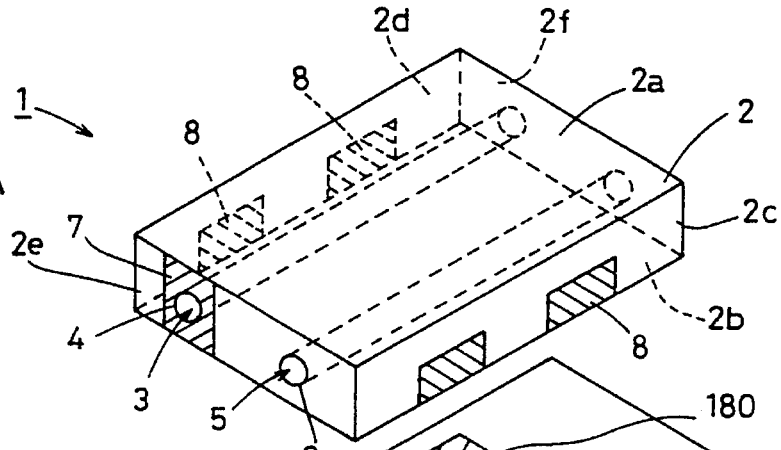
FIGS. 2A and 2B are perspective views showing a surface-mountable antenna according to a second embodiment of the present invention and a substrate for mounting the same respectively.
Figure 2B:
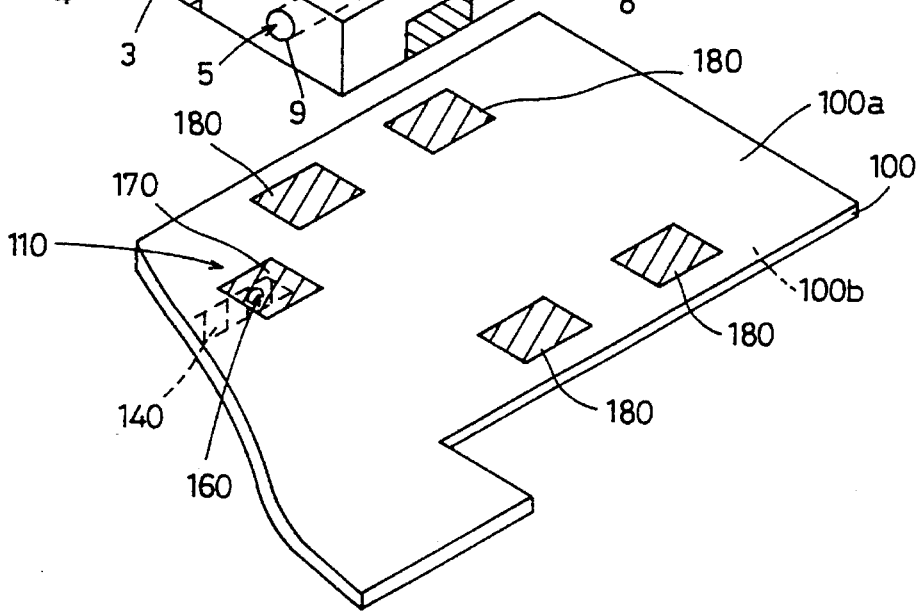

FIGS. 2A and 2B are perspective views showing a surface-mountable antenna according to a second embodiment of the present invention and a substrate for mounting the same respectively.

Portions identical or corresponding to those of the first embodiment are denoted by the same reference numerals, to omit redundant description.

In the second embodiment, the structure around a feeding through hole 3 is identical to that of the first embodiment. Namely, an end electrode 7 is formed on a first end surface 2*e* of a dielectric substrate 2 around the feeding through hole 3, so that this end electrode 7 is connected with a radiating electrode 4 which is formed on the inner peripheral surface of the feeding through hole 3. The end electrode 7 may alternatively be formed along the first end surface 2*e* and a bottom surface 2*b* of the dielectric substrate 2, in order to improve fixation strength with respect to a substrate described later.

On the other hand, a reflecting electrode 9 which is made of Cu, Ag, Ag—Pd or Ag—Pt is formed on the inner peripheral surface of an auxiliary through hole 5 by plating or application of conductive paste, for example.

Further, fixing electrodes 8 are formed on side surfaces 2*c* and 2*d* of the dielectric substrate 2 in positions symmetrical to each other. The positions, shapes and number of the fixing electrodes 8 are not particularly restricted but are appropriately selected in response to the fixation strength required and the required manufacturing cost. In other words, the fixing electrode 8 may be formed only on a second end surface 2*f*, or along the second end surface 2*f*, the side surface 2*c* or 2*d* and the bottom surface 2*b*. In consideration of providing fixation strength against an external impact, however, such electrodes provided on the outer surface(s) of the dielectric substrate 2 are preferably formed with symmetry as a whole.

A mounting state of the surface-mountable antenna 1 on a substrate 100 is now described.

The mounting substrate 100 is provided on its first main surface 100*a* with a feeding part 110 and fixing conductors 180. The feeding part 110 consists of a feeding conductor 170 and a feeding hole 160. The feeding hole 160 is formed to pass through the substrate 100. A conductor which is made of Cu, Ag, Ag—Pd or Ag—Pt, for example, is formed on the inner peripheral surface of the feeding hole 160. This feeding hole 160 is connected with a feeder line 140 which is formed on a second main surface of the substrate 100.

The surface-mountable antenna 1 is placed on the substrate 100 so that the end electrode 7 and the fixing electrodes 8 which are formed on the first end surface 2*e* and the side surfaces 2*c* and 2*d* of the dielectric substrate 2 face the feeding conductor 170 and the fixing conductors 180 which are formed on the first main surface 100*a* of the substrate 100 respectively, and connected and fixed to the substrate 100 by solder and an adhesive (not shown), for example.

In this surface-mountable antenna 1, the radiating electrode 4 is supplied with electricity from a feeding source (not shown) through the feeder line 140, the feeding hole 160, the feeding conductor 170 and the end electrode 7.

According to this embodiment, a radio wave radiated from the radiating electrode 4 which is formed on the inner peripheral surface of the feeding through hole 3 is reflected by the reflecting electrode 9 which is formed on the inner peripheral surface of the auxiliary through hole 5 when the feeding and auxiliary through holes 3 and 5 are at a relatively small distance a part (e.g., not more than ¼ wavelength), to intensively appear on the side of the feeding through hole 3. As compared with the prior art, the gain of the antenna 1 is improved in this case since the radio wave is radiated only toward one side.

When the feeding and auxiliary through holes 3 and 5 are separated from each other by an appropriate distance (e.g., about ½ wavelength), on the other hand, the radio wave which is radiated from the radiating electrode 4 intensively appears on the side of the auxiliary through hole 5.

According to the second embodiment, therefore, it is possible to control the directivity by selecting positions for forming the feeding and auxiliary through holes 3 and 5 in the dielectric substrate 2, thereby improving the gain of the antenna 1.

Third Embodiment

Figure 3:
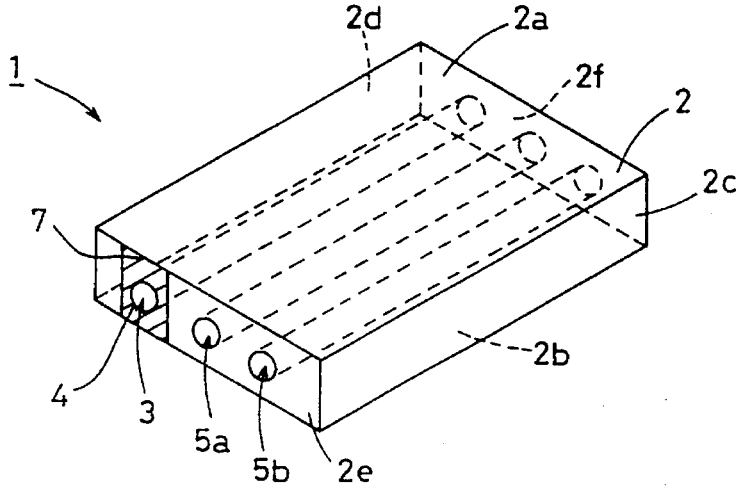
FIG. 3 is a perspective view showing a surface-mountable antenna according to a third embodiment of the present invention.

FIG. 3 is a perspective view showing a surface-mountable antenna 1 according to a third embodiment of the present invention.

Also in this embodiment, portions identical or corresponding to those of the first and second embodiments are denoted by the same reference numerals, to omit redundant description.

In the third embodiment, the structure around a feeding through hole 3 is identical to those of the first and second embodiments. Namely, an end electrode 7 is formed on a first end surface 2*e* of a dielectric substrate 2 around the feeding through hole 3, so that this end electrode 7 is connected with a radiating electrode 4 which is formed on the inner peripheral surface of the feeding through hole 3. The end electrode 7 may alternatively be formed along the first end surface 2*e* and a bottom surface 2*b* of the dielectric substrate 2, in order to improve fixation strength with respect to a substrate for mounting the antenna 1.

On the other hand, a pair of auxiliary through holes 5*a* and 5*b* are formed in the dielectric substrate 2 in parallel with the feeding through hole 3. Namely, the dielectric substrate 2 is provided with three through holes in parallel with each other.

The positions, shapes and the number of fixing electrodes 8 are not particularly restricted but may be appropriately selected in response to the necessary fixation strength and the required manufacturing cost, similarly to the first and second embodiments. In other words, the fixing electrodes 8 may be formed only on a second end surface 2f, or along the second end surface 2f, a side surface 2c or 2d and the bottom surface 2b. In consideration of providing fixation strength against an external impact, however, such electrodes provided on the outer surface(s) of the dielectric substrate 2 are preferably formed with symmetry as a whole.

The substrate for mounting the surface-mountable antenna 1 according to the third embodiment can be formed by either one of the substrates described with reference to the first and second embodiments. However, electrode patterns provided on the substrate are appropriately selected in response to the shapes and the number of the electrodes provided on the surface-mountable antenna 1 mounted thereon.

In the third embodiment, the directivity of the surface-mountable antenna 1 depends on whether or not reflecting electrodes are formed on the respective inner peripheral surfaces of the auxiliary through holes 5a and 5b.

When reflecting electrodes are formed on the respective inner peripheral surfaces of the auxiliary through holes 5a and 5b, a radio wave radiated from a radiating electrode 4 which is formed on the inner peripheral surface of the feeding through hole 3 is reflected by these reflecting electrodes, to intensively appear on the side of the feeding through hole 3. The directivity toward the side provided with no auxiliary through holes is increased as the number of the auxiliary through holes (the number of the reflecting electrodes) is increased.

When no reflecting electrodes are formed on the respective inner peripheral surfaces of the auxiliary through holes 5a and 5b, on the other hand, the dielectric constant of the dielectric substrate 2 is reduced on the side of the auxiliary through holes 5a and 5b, due to the formation of the auxiliary through holes 5a and 5b. In general, a radio wave tends to appear more intensely on a side having a lower dielectric constant, so the directivity toward this side is increased. Therefore, it is possible to change the dielectric constant by selecting the position of the feeding through hole 3 and the number and diameters of the auxiliary through holes 5a and 5b. Thus, it is possible to control the directivity, thereby improving the gain of this antenna 1.

Fourth Embodiment

Figure 4:
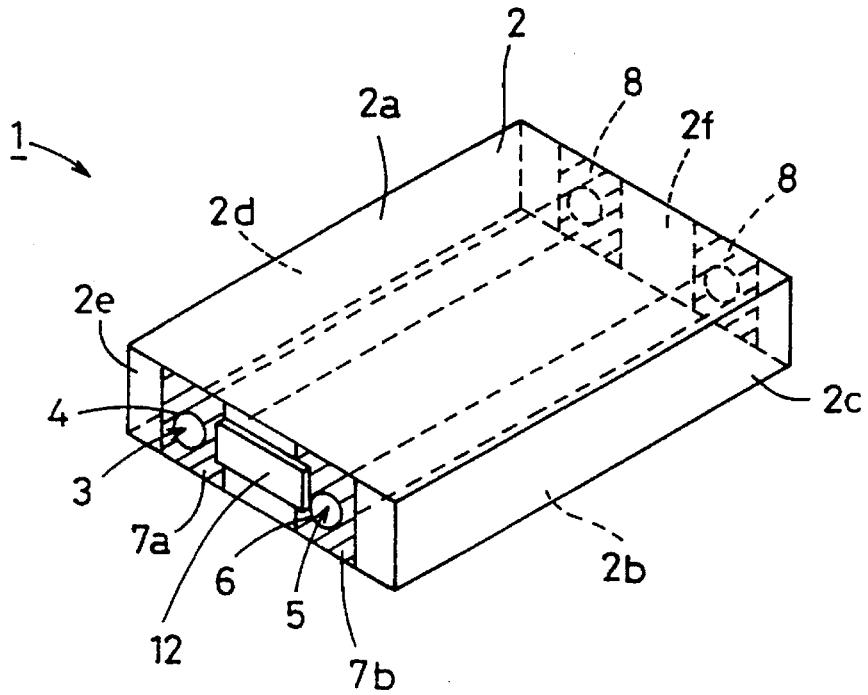
FIG. 4 is a perspective view showing a surface-mountable antenna according to a fourth embodiment of the present invention.
Figure 5A:
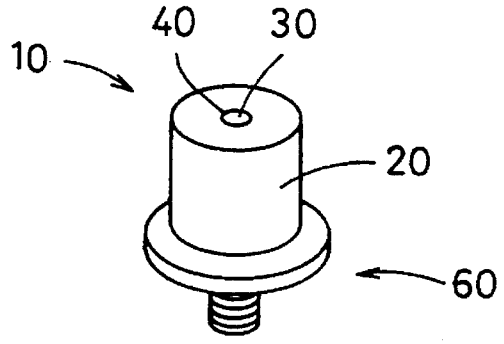
FIG.5A PRIOR ART
FIGS. 5A and 5B are perspective views showing an antenna of a communication device according to the prior art and the body of the communication device respectively.
Figure 5B:
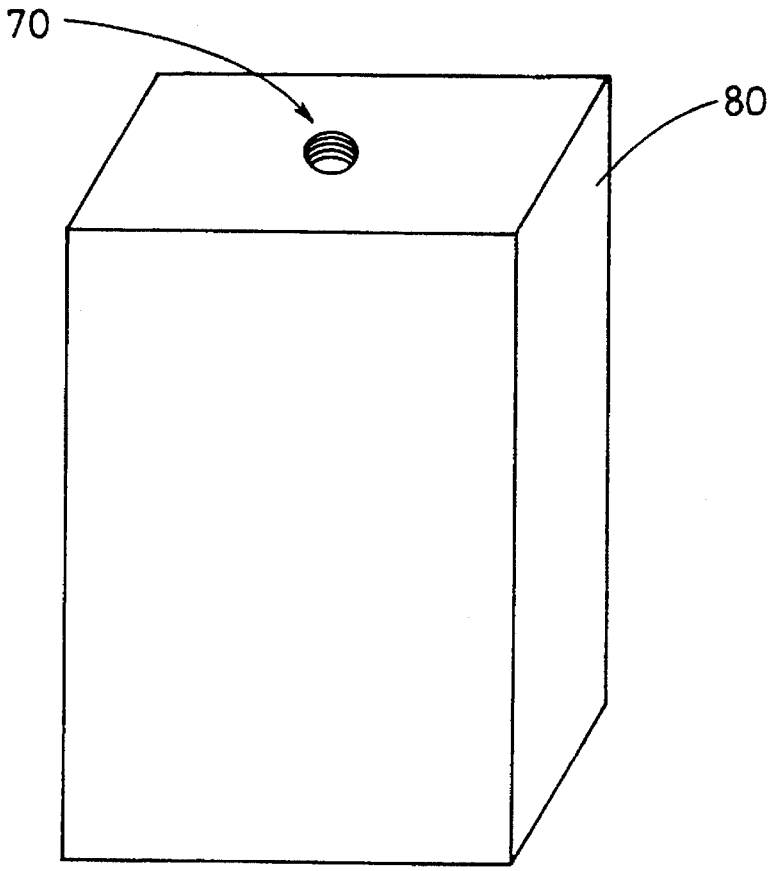
FIG.5B PRIOR ART
Figure 6:
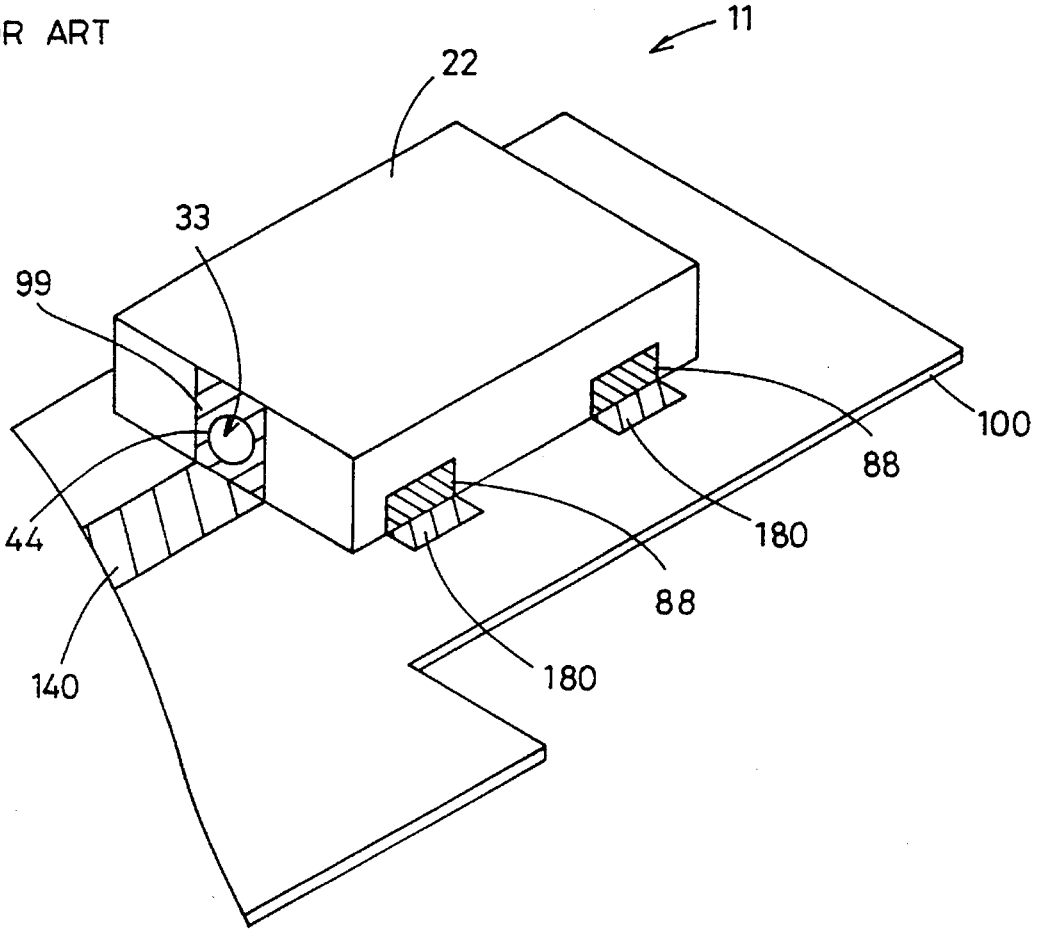
FIG.6 PRIOR ART
FIG. 6 is another perspective view showing a surface-mountable antenna according to another prior art.

FIG. 4 is a perspective view showing a surface-mountable antenna 1 according to a fourth embodiment of the present invention.

Also in this embodiment, portions identical or corresponding to those of the first to third embodiments are denoted by the same reference numerals, to omit redundant description.

As compared with the first embodiment, the feature of the fourth embodiment resides in that a chip-type capacitor 12 is fixed to a first end surface 2e of a dielectric substrate 2.

In the surface-mountable antenna 1 according to the fourth embodiment, the capacitor 12 is arranged between end electrodes 7a and 7b, so that this capacitor 12 is connected and fixed to the end electrodes 7a and 7b by an adhesive and solder.

Thus, the degree of coupling between feeding and auxiliary through holes 3 and 5, which are coupled with each other by the end electrodes 7a and 7b, is further changed by the capacitor 12. It is possible to control the directivity of the antenna 1 by selecting the capacitance value of the capacitor 12.

Also when a chip coil or a chip resistance is employed in place of the capacitor 12, it is possible to change the degree of coupling between the feeding and auxiliary through holes 3 and 5 for controlling the directivity.

In the fourth embodiment, states of formation of fixing electrodes and a mounting structure of the antenna 1 on a mounting substrate are similar to those of the first to third embodiments.

While the surface-mountable antenna 1 according to each of the first to fourth embodiments has a rectangular plane shape, the present invention is not restricted to this but the antenna may alternatively have a square plane shape. While the through holes are formed along the longitudinal direction of dielectric substrate, further, the present invention is not restricted to this but the subject matter thereof remains unchanged also when the through holes are formed along the shorter sides of the dielectric substrate.

In addition, the substrate, which is provided on its first main surface with the feeder line, employed in the first embodiment, may also be applied to the second embodiment. Further, the substrate, which is provided on its second main surface with the feeder line, employed in the second embodiment, may also be applied to the first embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A surface-mountable antenna comprising:

a dielectric substrate with a mounting surface for being mounted on a mounting substrate, the mounting substrate having a feeding part for supplying the antenna with signal;

a feeding through hole being formed to pass through said dielectric substrate along said mounting surface;

at least one auxiliary through hole being formed to pass through said dielectric substrate in parallel with said feeding through hole, an auxiliary electrode being formed on the inner peripheral surface of said at least one auxiliary through hole and electrically isolated from said feeding part; and a radiating electrode being formed on the inner peripheral surface of said feeding through hole and arranged for being supplied with said signal from said feeding part on said mounting substrate.

2. The surface-mountable antenna in accordance with claim 1, further comprising:

a first end electrode being formed on a first end surface of said dielectric substrate, said first end surface being provided with respective first opening portions of said feeding and auxiliary through holes, said first end electrode being formed around said opening portion of said feeding through hole to be interposed between said feeding part and said radiating electrode, and a second end electrode being formed on said first end surface of said dielectric substrate around said auxiliary through hole to be connected to said auxiliary electrode.

3. The surface-mountable antenna in accordance with claim 2, further comprising:

a third end electrode being formed on a second end surface of said dielectric substrate, said second end surface being provided with respective second opening portions of said feeding and auxiliary through holes, said third end electrode being formed around said opening portion of said feeding through hole to be connected to said radiating electrode, and a fourth end electrode being formed on said second end surface of said dielectric substrate around said auxiliary through hole to be connected to said auxiliary electrode.

4. The surface-mountable antenna in accordance with claim 3, further comprising said mounting substrate, and a plurality of fixing electrodes, corresponding to said second, third and fourth end electrodes respectively, being formed on said mounting substrate in positions being in contact with said second, third and fourth end electrodes respectively.

5. The surface-mountable antenna in accordance with claim 1, wherein the distance between said feeding through hole being provided with said radiating electrode and said auxiliary hole being provided with said auxiliary electrode is not more than ¼ of a wavelength of a radio signal being radiated from said radiating electrode.

6. The surface-mountable antenna in accordance with claim 5, further comprising said mounting substrate, and a radio signal source associated with said mounting substrate supplying said radio signal having said wavelength to said antenna via said feeding part.

7. The surface-mountable antenna in accordance with claim 1, wherein the distance between said feeding through hole being provided with said radiating electrode and said auxiliary hole being provided with said auxiliary reflecting electrode is ½ of a wavelength of a radio signal being radiated from said radiating electrode.

8. The surface-mountable antenna in accordance with claim 7, further comprising said mounting substrate, and a radio signal source associated with said mounting substrate supplying said radio signal having said wavelength to said antenna via said feeding part.

9. The surface-mountable antenna in accordance with claim 1, further comprising a plurality of fixing electrodes being formed on a side surface of said dielectric substrate and extending in a direction parallel to said feeding and auxiliary through holes.

10. The surface-mountable antenna in accordance with claim 9, further comprising said mounting substrate, and a plurality of fixing conductors, corresponding to said plurality of fixing electrodes respectively, being formed on said mounting substrate in positions being in contact with said plurality of fixing electrodes respectively.

11. The surface-mountable antenna in accordance with claim 1, further comprising a capacitor electrically connecting said feeding and auxiliary through holes with each other.

12. The surface-mountable antenna in accordance with claim 1, further comprising a resistive element electrically connecting said feeding and auxiliary through holes with each other.

13. The surface-mountable antenna in accordance with claim 1, further comprising an inductance electrically connecting said feeding and auxiliary through holes with each other.

14. The surface-mountable antenna in accordance with claim 1, wherein said dielectric substrate has a rectangular plane shape.

15. The surface-mountable antenna in accordance with claim 1, further comprising a capacitor electrically connected between said first and second end electrodes.

16. A surface-mountable antenna comprising:

a dielectric substrate with a mounting surface for being mounted on a mounting substrate, the mounting substrate having a feeding part for supplying the antenna with a signal;

one feeding through hole being formed to pass through said dielectric substrate along said mounting surface;

a single auxiliary through hole being formed to pass through said dielectric substrate in parallel with said feeding through hole, an auxiliary electrode being formed on the inner peripheral surface of said auxiliary through hole and electrically isolated from said feeding part; and a radiating electrode being formed on the inner peripheral surface of said feeding through hole and arranged for being supplied with said signal from said feeding part on said mounting substrate.

17. A surface-mountable antenna comprising:

a dielectric substrate with a mounting surface for being mounted on a mounting substrate, the mounting substrate having a feeding part for supplying the antenna with a signal;

one feeding through hole being formed to pass through said dielectric substrate along said mounting surface;

a plurality of auxiliary through holes being formed to pass through said dielectric substrate in parallel with said feeding through hole, an auxiliary electrode being formed on the inner peripheral surface of each of said auxiliary through hole and electrically isolated from said feeding part; and a radiating electrode being formed on the inner peripheral surface of said feeding through hole and arranged for being supplied with said signal from said feeding part on said mounting substrate.

18. A method of transmitting radio signals with a surface-mountable antenna, comprising the steps of:

providing a signal source for supplying a radio signal having a wavelength;

providing a mounting substrate having a feeding part for receiving said radio signal from said signal source and supplying said signal to an antenna mounted on said mounting substrate;

providing a dielectric substrate with a mounting surface for being mounted on a mounting substrate;

forming a feeding through hole passing through said dielectric substrate along said mounting surface, with a radiating electrode on the inner peripheral surface of said feeding through hole, said radiating electrode being supplied with said signal from said feeding part on said mounting substrate;

forming at least one auxiliary through hole passing through said dielectric substrate in parallel with said feeding through hole and electrically isolated from said feeding part, with a reflecting electrode on the inner peripheral surface of said auxiliary through hole;

mounting the dielectric substrate on said mounting substrate via said mounting surface; and adjusting the spacing between said feeding and auxiliary through holes so as to control a direction of radiation of said radio signal by said antenna.

* * * * *